US008166583B1

(12) United States Patent
Liang

(10) Patent No.: US 8,166,583 B1
(45) Date of Patent: May 1, 2012

(54) BATH CURTAIN RACK STRUCTURE

(76) Inventor: Huang-Kai Liang, Xiushui Township, Changhua County (TW)

( * ) Notice: Subject to any disclaimer, the term of this patent is extended or adjusted under 35 U.S.C. 154(b) by 0 days.

(21) Appl. No.: 13/100,320

(22) Filed: May 4, 2011

(51) Int. Cl.
*A47K 3/00* (2006.01)

(52) U.S. Cl. ..... 4/610; 4/558; 4/608; 4/609; 211/105.2

(58) Field of Classification Search ..... 4/558, 607–609, 4/610; 248/251, 254, 262, 534; 211/96, 211/105.1–105.4
See application file for complete search history.

(56) References Cited

U.S. PATENT DOCUMENTS

| | | | | |
|---|---|---|---|---|
| 5,189,759 | A * | 3/1993 | Poore | 4/558 |
| 7,346,940 | B1 * | 3/2008 | Liao | 4/558 |
| 8,069,508 | B2 * | 12/2011 | O'Connell | 4/610 |
| 2007/0169260 | A1 * | 7/2007 | Huang | 4/558 |

* cited by examiner

*Primary Examiner* — Gregory Huson
*Assistant Examiner* — Erin Deery
(74) *Attorney, Agent, or Firm* — Jackson IPG PLLC; Demian K. Jackson

(57) ABSTRACT

A bath curtain rack structure includes a curved transverse rod, two pivot members and two wall-mounted brackets. The curved transverse rod has two ends which are connected to hollow pipe portions of the pivot members, respectively. Each pivot member includes a flat rounded end with a semi-circle flange at one end thereof. Each wall-mounted bracket includes a central protruding post which is inserted in a dual awl-shaped guide hole of the pivot member. The wall-mounted bracket further has a pair of lock holes for insertion of screws to be secured on a wall, a recess corresponding in shape to the flat round end, two stoppers to stop the semi-circle flange, and a protruding opening to receive the flat rounded end and the semi-circle flange of the pivot member. A second headless screw is screwed in a second threaded hole of the flat rounded end to engage with the concave pivot point. A first headless screw is screwed in a first threaded hole of the pivot member to engage with the ends of the curved transverse rod.

3 Claims, 4 Drawing Sheets

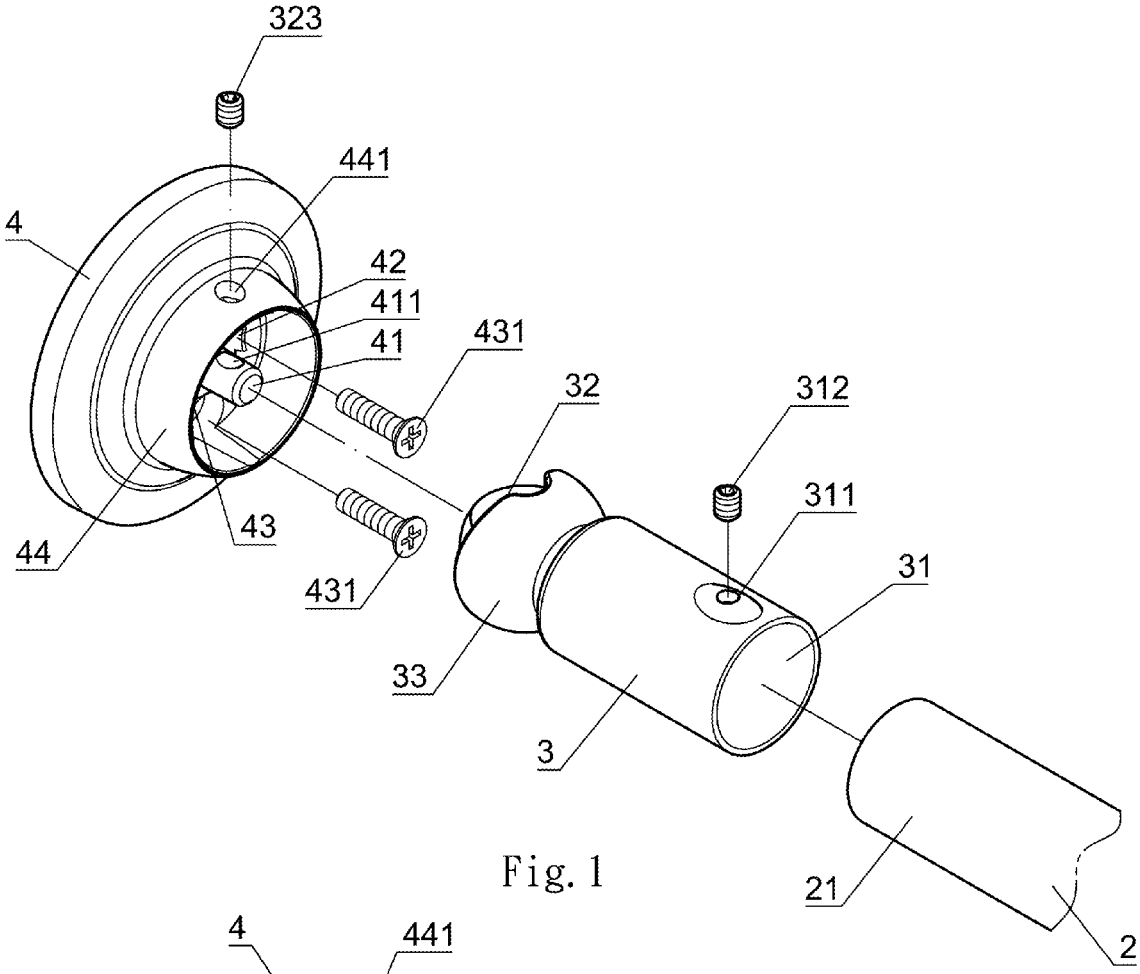
Fig. 1
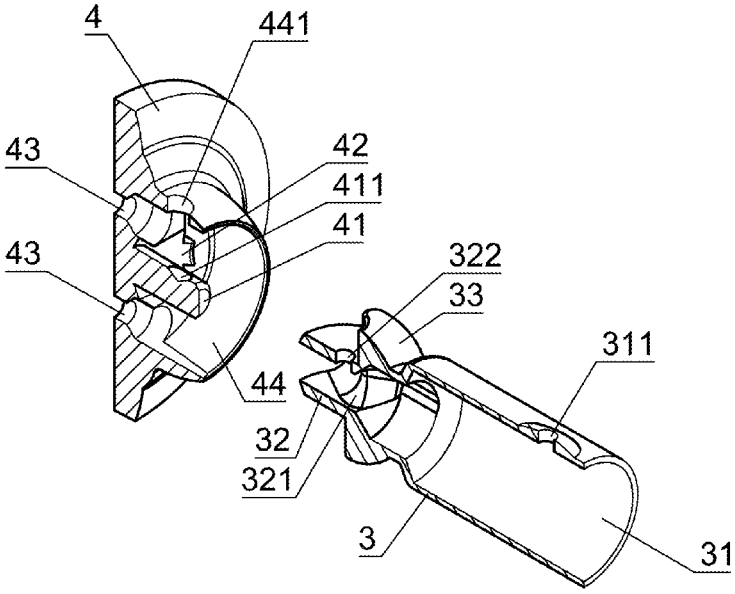
Fig. 1-A

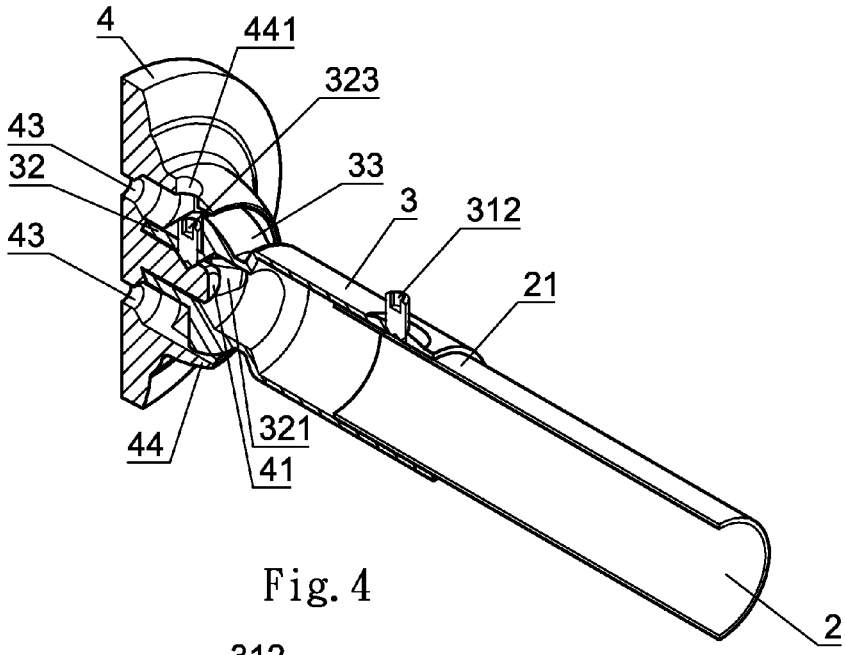
Fig. 4
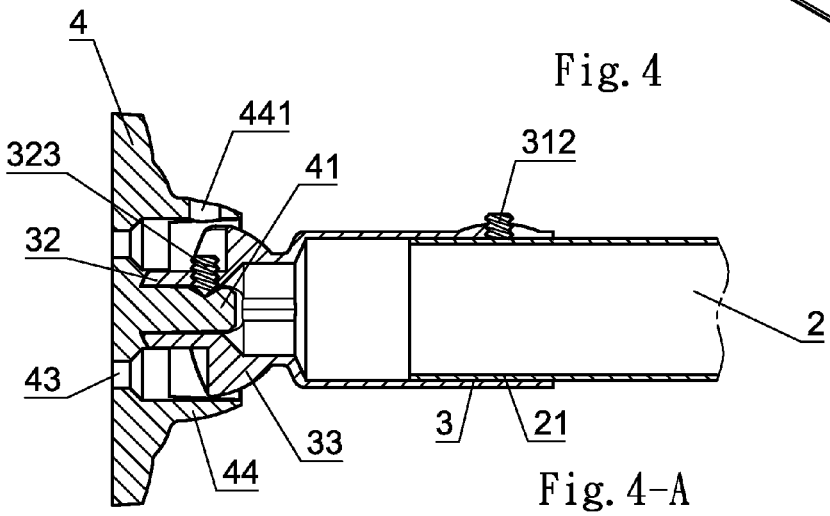
Fig. 4-A
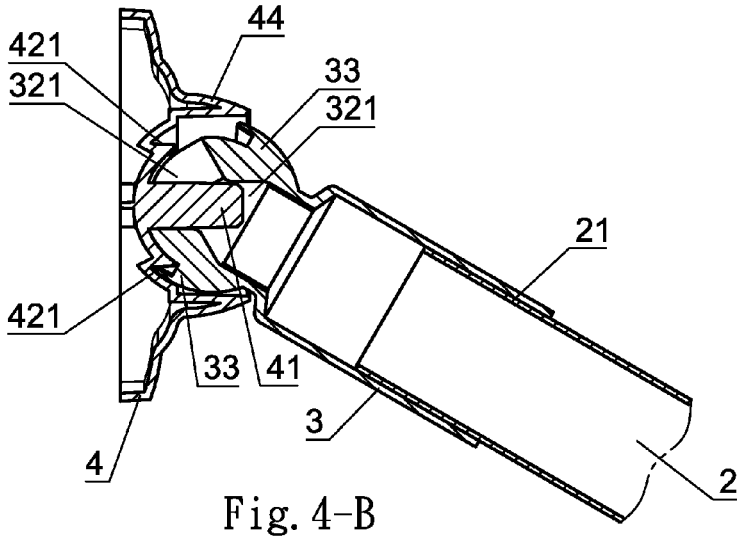
Fig. 4-B

BATH CURTAIN RACK STRUCTURE

BACKGROUND OF THE INVENTION

1. Field of the Invention

The present invention relates to a bath curtain rack structure, and more particularly to one having a curved transverse rod, a pair of pivot members and a pair of wall-mounted brackets. The curved transverse rod has two ends which are respectively connected to hollow pipe sections of the pivot members. Each pivot member has a flat round end and a semi-circle flange which are pivotally connected to a protruding opening of the wall-mounted bracket, providing a simple and stable assembly.

2. Description of the Prior Art

A conventional bath curtain rack comprises a screw extending through an adjustment mechanism provided at the center of a base and connected to a pivot rod of the base. Alternatively, a bolt extends through a central through hole of the pivot rod and is screwed to the adjustment mechanism of the base. In assembly, the position of the base and the pivot rod must be first adjusted and then secured to the wall. Alternatively, the base is secured to the wall and then the pivot rod is adjusted to be secured thereat. During adjustment, the transverse rod must be primarily considered and the alignment is repeated for connection. The assembly must be made with great precision, which is inconvenient for operation and may be loosened easily. Accordingly, the inventor of the present invention has devoted himself based on his many years of practical experiences to solve this problem.

SUMMARY OF THE INVENTION

According to the present invention, there is provided a bath curtain rack structure which comprises a curved transverse rod, a pair of pivot members and a pair of wall-mounted brackets. The curved transverse rod has two ends which are connected to the pair of pivot members, respectively. Each pivot member includes a hollow pipe portion at one end thereof for insertion of the ends of the curved transverse rod, a first threaded hole at one side thereof for insertion of a first headless screw which is screwed to engage with the ends of the curved transverse rod, and a flat rounded end with a semi-circle flange at an opposite end thereof. The flat rounded end is pivotally connected to the wall-mounted bracket. The flat rounded end has a dual awl-shaped guide hole therein for insertion of a protruding post and a second threaded hole at a top thereof for insertion of a second headless screw which is screwed to engage with a concave pivot point of the protruding post to limit rotation. Each wall-mounted bracket includes the central protruding post which has the concave pivot point at a front section thereof. The central protruding post is inserted in the dual awl-shaped guide hole. The wall-mounted bracket further has a pair of lock holes for insertion of screws to be secured on a wall, a recess corresponding in shape to the flat round end, two stoppers to stop the semi-circle flange, a protruding opening to receive the flat rounded end and the semi-circle flange of the pivot member, and a through hole at one side thereof which is perpendicular to the concave pivot point and for insertion of the second headless screw. The two wall-mounted brackets are secured to the wall at the same height. The flat rounded end and the semi-circle flange of each pivot member are inserted in the protruding opening. The protruding post is inserted in the dual awl-shaped guide hole. The second headless screw is screwed in the second threaded hole to engage with the concave pivot point so as to be positioned thereat. The flat rounded end mates with the recess. The two ends of the curved transverse rod are inserted in the hollow pipe portions of the two pivot members. The first headless screw is screwed in the first threaded hole to engage with the ends so as to connect the curved transverse rod. The present invention provides a simple assembly and disassembly and can be positioned with ease.

When the pivot member is adjusted with the concave pivot point as an axis, the adjustment of the pivot member will be limited by the engagement of the protruding post and the dual awl-shaped guide hole. The semi-circle flange is stopped by the stopper, preventing the protruding post from breaking due to over turning. Two wall-mounted brackets are connected with a connecting board to become a bracket unit. Two bracket units are secured to the wall at the same height and two curved transverse rods are assembled in accordance with the aforesaid process to enhance the hanging effect.

BRIEF DESCRIPTION OF THE DRAWINGS

FIG. 1 is an exploded view according to a preferred embodiment of the present invention;

FIG. 1-A is a side sectional view of the pivot member and the wall-mounted bracket according to the preferred embodiment of the present invention;

FIG. 4 is a perspective sectional view according to the preferred embodiment of the present invention;

FIG. 4-A is a lengthwise sectional view according to the preferred embodiment of the present invention;

FIG. 4-B is a transverse sectional view according to the preferred embodiment of the present invention;

DETAILED DESCRIPTION OF THE PREFERRED EMBODIMENTS

Embodiments of the present invention will now be described, by way of example only, with reference to the accompanying drawings.

Figure 2:
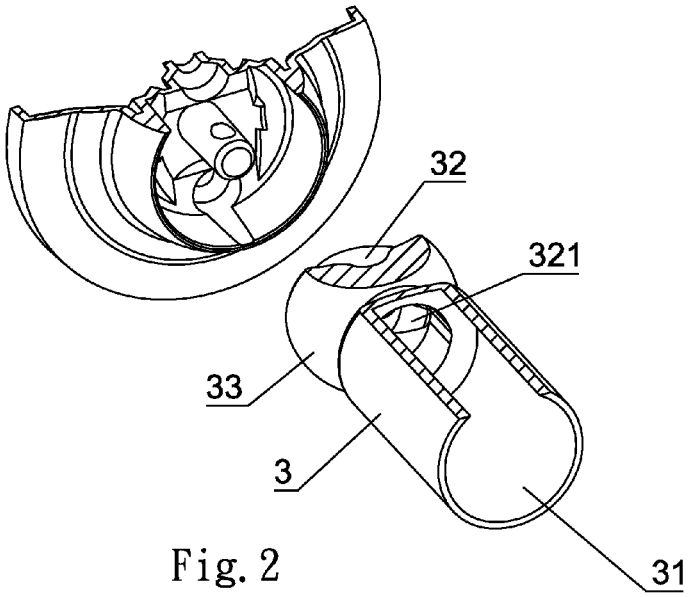
FIG. 2 is a cross-sectional view of the pivot member and the wall-mounted bracket according to the preferred embodiment of the present invention.
Figure 3:
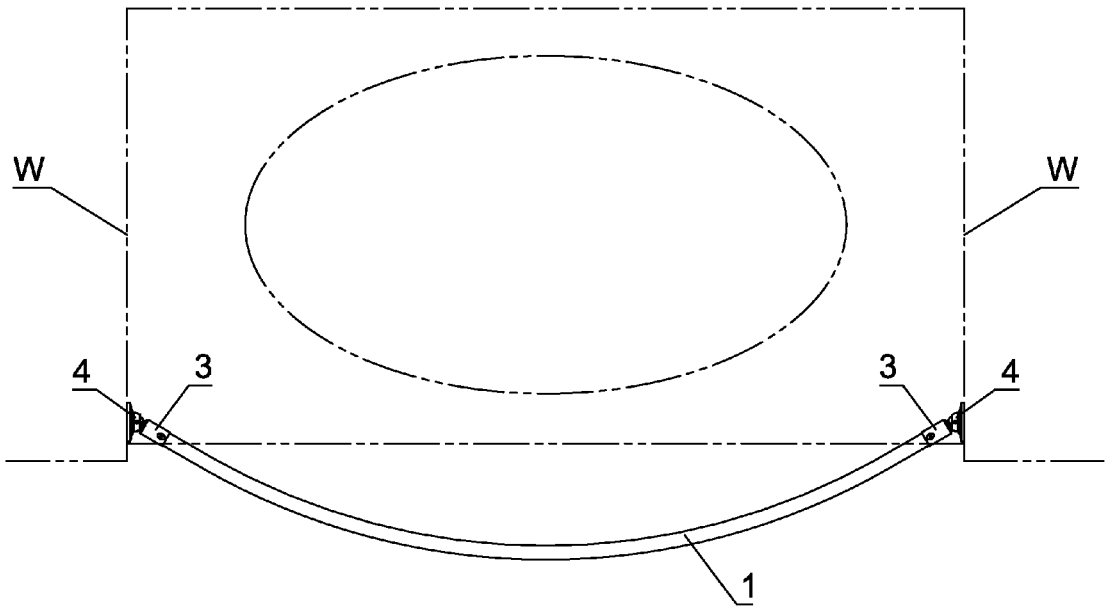
FIG. 3 is a schematic view of the preferred embodiment of the present invention when in use.

As shown in FIGS. 1 through 3 and FIG. 1-A, a bath curtain rack structure according to a preferred embodiment of the present invention comprises a curved transverse rod 2, a pair of pivot members 3 and a pair of wall-mounted brackets 4.

The curved transverse rod 2 is in the form of a pipe and has two ends 21 which are connected to the pair of pivot members 3, respectively. The curved transverse rod 2 can be used for hanging a show curtain B to be slid thereon.

Each pivot member 3 includes a hollow pipe portion 31 at one end thereof for insertion of the ends 21 of the curved transverse rod 2, a first threaded hole 311 at one side thereof for insertion of a first headless screw 312 which is screwed to engage with the ends 21 of the curved transverse rod 2, and a flat rounded end 32 with a semi-circle flange 33 at an opposite end thereof. The flat rounded end 32 is pivotally connected to the wall-mounted bracket 4. The flat rounded end 32 has a dual awl-shaped guide hole 321 therein for insertion of a protruding post 41 and a second threaded hole 322 at a top thereof for insertion of a second headless screw 323 which is screwed to engage with a concave pivot point 411 of the protruding post 41 to limit rotation.

Each wall-mounted bracket 4 includes the central protruding post 41 which has the concave pivot point 411 at a front section thereof. The central protruding post 41 is inserted in the dual awl-shaped guide hole 321. The wall-mounted bracket 4 further has a pair of lock holes 43 for insertion of screws 431 to be secured on a wall W, a recess 42 corresponding in shape to the flat round end 32, two stoppers 421 to stop the semi-circle flange 33, a protruding opening 44 to receive the flat rounded end 32 and the semi-circle flange 33 of the pivot member 3, and a through hole 441 at one side thereof which is perpendicular to the concave pivot point 411 and for insertion of the second headless screw 323. By this structure, the bath curtain rack can be assembled quickly and firmly, which is convenient for use.

Figure 5:
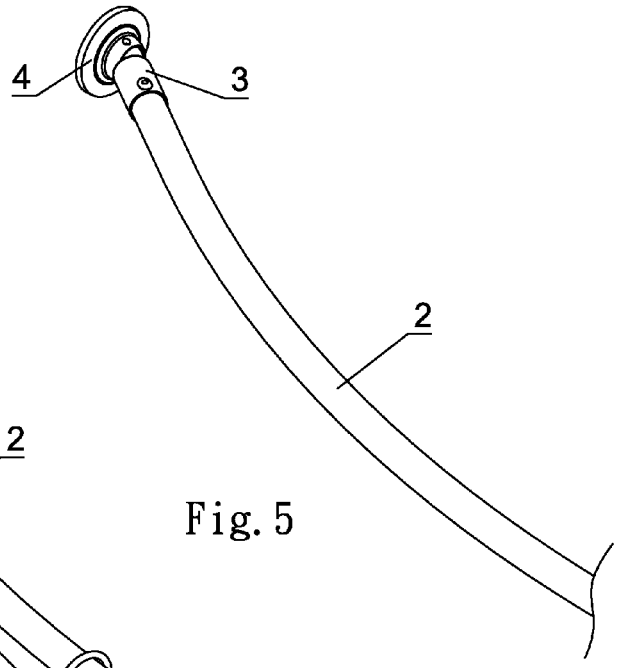
FIG. 5 is a perspective view according to the preferred embodiment of the present invention.

Referring to FIG. 4, FIG. 5, FIG. 4-A and FIG. 4-B, the two wall-mounted brackets 4 are secured to the wall W at the same height. The flat rounded end 32 and the semi-circle flange 33 of each pivot member 3 are inserted in the protruding opening 44. The protruding post 41 is inserted in the dual awl-shaped guide hole 321. The flat rounded end 32 mates with the recess 42, and the second headless screw 323 is inserted through the through hole 441 and screwed in the second threaded hole 322 to engage with the concave pivot point 411 so as to be positioned thereat. After that, the two ends 21 of the curved transverse rod 2 are inserted in the hollow pipe portions 31 of the two pivot members 3. The first headless screw 312 is screwed in the first threaded hole 311 to engage with the end 21 so as to connect the curved transverse rod 2. When the pivot member 3 is adjusted with the concave pivot point 411 as an axis, the adjustment of the pivot member 3 will be limited by the engagement of the protruding post 41 and the dual awl-shaped guide hole 321. The semi-circle flange 33 is stopped by the stopper 421, preventing the protruding post 41 from breaking because of over turning. The present invention provides a simple assembly and disassembly and can be positioned with ease.

Figure 6:
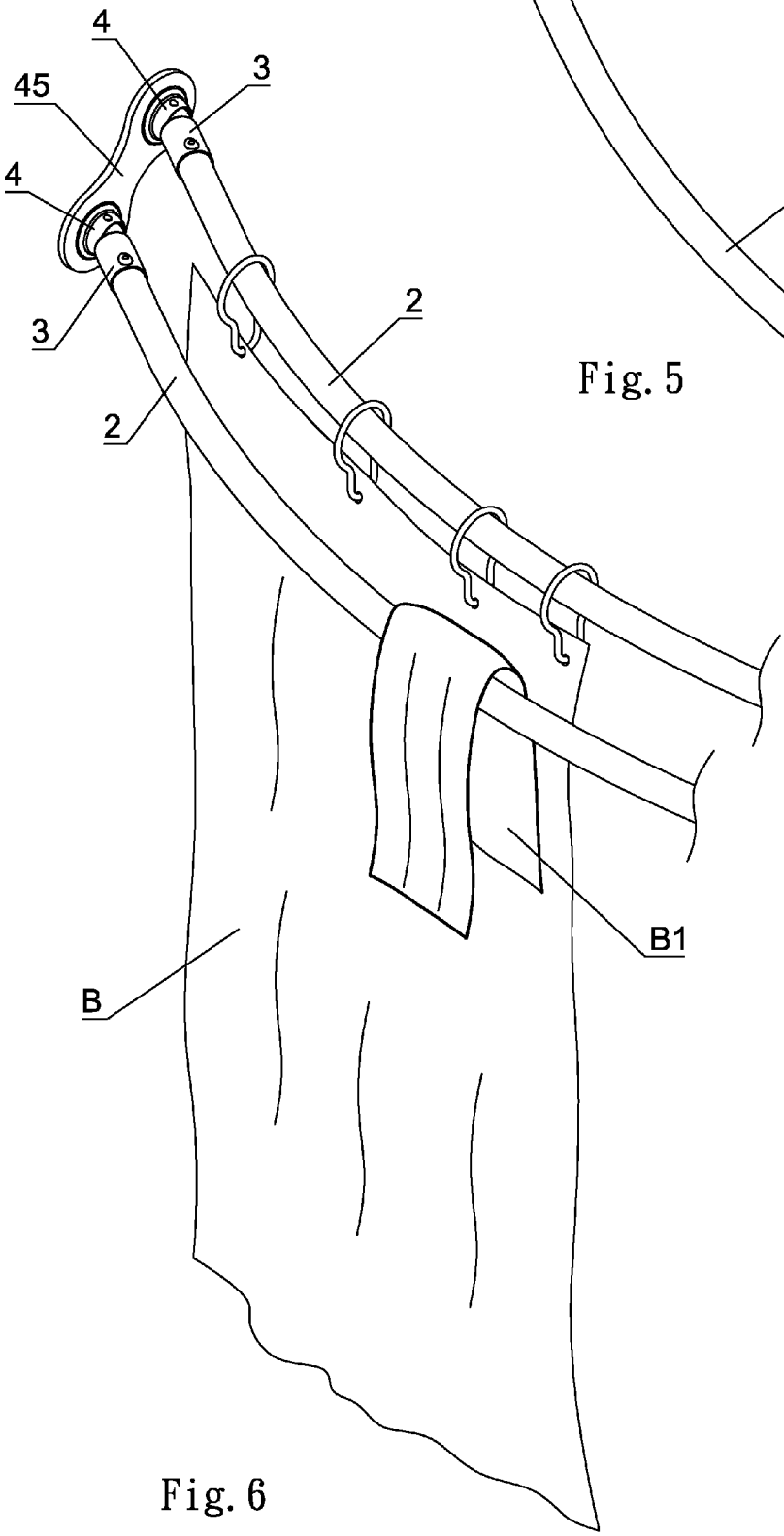
FIG. 6 is a perspective view according to the preferred embodiment of the present invention incorporated with a connecting board.

Referring to FIG. 6, two wall-mounted brackets 4 are connected with a connecting board 45 to become a bracket unit. Two bracket units are secured to the wall W at the same height. Four pivot members 3 and two curved transverse rods 2 are assembled in accordance with the aforesaid process, such that a bath curtain B or a towel B1 can be hung on the two curved transverse rods 2 to enhance the hanging effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A bath curtain rack structure, comprising a curved transverse rod, a pair of pivot members and a pair of wall-mounted brackets, the curved transverse rod having two ends which are respectively connected to the pair of pivot members, the pair of brackets being secured to a wall, characterized by:

each pivot member including a hollow pipe portion at one end, a first threaded hole at one side thereof for insertion of a first headless screw which is screwed to engage with the ends of the curved transverse rod, and a flat rounded end with a semi-circle flange at an opposite end thereof, the flat rounded end having a dual awl-shaped guide hole therein and a second threaded hole at a top thereof for insertion of a second headless screw which is screwed to engage with a concave pivot point of a central protruding post of the wall-mounted bracket;

each wall-mounted bracket including the central protruding post which has the concave pivot point at a front section thereof, each wall-mounted bracket further having a pair of lock holes for insertion of screws to be secured on the wall, a recess corresponding in shape to the flat round end, two stoppers to stop the semi-circle flange, a protruding opening to receive the flat rounded end and the semi-circle flange of the pivot member, and a through hole at one side thereof which is perpendicular to the concave pivot point and for insertion of the second headless screw;

thereby, the pivot members being connected the wall-mounted brackets, the second headless screw being screwed in the second threaded hole of the flat round end to engage with the concave pivot point and the protruding post inserting in the dual awl-shaped guide hole to limit turning, the first headless screw being screwed in the first threaded hole to engage with the ends of the curved transverse rod.

2. The bath curtain rack structure as claimed in claim 1, wherein when the pivot member is adjusted with the concave pivot point as an axis, the adjustment of the pivot member is limited by the engagement of the protruding post and the dual awl-shaped guide hole, and the semi-circle flange is stopped by the stoppers.

3. The bath curtain rack structure as claimed in claim 1, wherein two wall-mounted brackets are connected with a connecting board to become a bracket unit for connecting two curved transverse rods.

* * * * *